US006781295B2

(12) United States Patent
Dakin et al.

(10) Patent No.: US 6,781,295 B2
(45) Date of Patent: Aug. 24, 2004

(54) ONE PIECE CLIP FOR MOUNTING LIGHT SOURCE TO REFLECTOR

(75) Inventors: James T. Dakin, Shaker Heights, OH (US); Matthew A. Bugenske, Cleveland Heights, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/331,195

(22) Filed: Dec. 27, 2002

(65) Prior Publication Data

US 2003/0168959 A1 Sep. 11, 2003

Related U.S. Application Data

(63) Continuation of application No. 09/443,605, filed on Nov. 19, 1999, now abandoned.

(51) Int. Cl.[7] ..... H01J 5/50
(52) U.S. Cl. ..... 313/318.07; 313/318.09
(58) Field of Search ..... 313/318.01–318.11, 313/113; 362/341, 350

(56) References Cited

U.S. PATENT DOCUMENTS

| | | | |
|---|---|---|---|
| 4,012,658 | A | 3/1977 | Vause |
| 4,864,183 | A | 9/1989 | Okano |
| 5,013,961 | A | 5/1991 | Reedy |
| 5,057,735 | A | 10/1991 | Zalar et al. |
| 5,506,763 | A | 4/1996 | Carley |
| 5,744,901 | A | 4/1998 | Friedrichs et al. |
| 6,215,236 | B1 | 4/2001 | Gotoh et al. |

*Primary Examiner*—Joseph Williams
(74) *Attorney, Agent, or Firm*—Fay, Sharpe, Fagan, Minnich & McKee, LLP

(57) ABSTRACT

A lamp assembly (10) includes a body (12) having a concave reflecting surface (16) that opens toward a first or open end (18) and a neck (22) at a second end includes an opening (24). A light source (30) is received in the body adjacent the reflecting surface and has a seal or pinch region (44) which extends into the neck. A mounting clip (80) includes a plate (82) that engages the outer surface of the neck. First and second legs (84, 86) of the mounting clip engage the pinch region via teeth (88), while arms (90, 92) engage an internal surface (94) of the neck.

19 Claims, 3 Drawing Sheets

ONE PIECE CLIP FOR MOUNTING LIGHT SOURCE TO REFLECTOR

This application is a continuation application of U.S. Ser. No. 09/443,605, filed Nov. 19, 1999, now abandoned.

BACKGROUND OF THE INVENTION

1. Field of the Invention

This application relates to securing a light source to a housing opening without using cement. More particularly, the application is directed to a clip for mounting or securing a ceramic metal halide light source to the neck of a reflector, although it will be appreciated that it will also find use with any light source having a glass or quartz seal where the mounting clip can engage the seal area and secure the light source to the reflector body.

2. Discussion of the Art

Existing lamp designs typically cement a light source inside a reflector. For example, in a halogen reflector lamp, the light source is a filament tube and it is desirable for the filament tube to be located near a focal point of the reflector. This is achieved by aligning and cementing relatively stiff leads of the filament tube to the reflector. The leads are made, for example, of a nickel-iron alloy and extend through the neck of the reflector where they are subsequently fixed in place with a high-temperature cement. Although the cement is effective in holding the light source in place, it is desirable to eliminate the curing process associated with the cement, or eliminate use of the cement in its entirety because of the increased time associated to manufacture lamps according to this arrangement. More recent designs use a glass support member, or what is often referred to as a button, which has a pair of small diameter openings that receive the leads therethrough. The button provides a wall or a bottom to the neck cavity to hold the cement in place as it is cured.

Generally, the same mounting arrangement used with halogen reflector lamps has been employed with regard to securing ceramic arc tubes in an associated reflector neck. As will be appreciated, the light source for a ceramic metal halide includes a pair of arc leads spaced apart in a ceramic arc tube. The arc tube is enclosed in a quartz capsule to provide a hermetically sealed environment. A pair of molybdenum foils are sealed in a pinch region of the quartz capsule and molybdenum leads extend outwardly from the foils in the pinch region for electrical connection with an external source. The external molybdenum leads are not as stiff as nickel-iron leads. Due to the difference in stiffness, the ceramic metal halide reflector lamps encounter increased damage during shipment or transit since the molybdenum leads are less stiff and the ceramic metal halide capsule is significantly heavier than the equivalent halogen filament tube.

As noted above, presently available commercial embodiments of the ceramic metal halide lamps support the capsule by cementing it directly to the neck of the reflector. This requires that the quartz capsule pinch region be dimensioned sufficiently small to fit through the opening in the end of the reflector neck. The assignee of the present application employs a glass button for receipt through the neck opening to support the ceramic metal halide capsule where the button is held in place with cement. Commonly assigned, co-pending U.S. application Ser. No. 09/075,609, filed May 11, 1998, now U.S. Pat. No. 6,163,102, is directed to a preferred mounting arrangement having improved shock and vibration characteristics.

Nevertheless, the elimination of cement is still a desirable goal because of the difficulty encountered in handling the lamp components, controlling the introduction of the cement, and the extended time required to cure the cement. Thus, although the noted arrangement in the commonly assigned application demonstrates improvements in mounting a ceramic metal halide capsule to a reflector body, further improvements are desired.

U.S. Pat. No. 5,744,901 discloses a reflector lamp for a ceramic metal halide capsule that uses an annular sleeve to grip an external portion of the neck and light source. However, the circumferential wall of the mounting member is secured to the reflector body with a relief so that even if directed to a cement-free arrangement, the complex shape of the mounting member appears expensive to tool. Furthermore, the assembly would require expensive changes in all of the associated lamp components; namely, the capsule, base, and reflector.

Thus, a need exists to provide a simple, cement-free arrangement for securing a ceramic metal halide capsule to a reflector body with minimal modification to the lamp components.

BRIEF SUMMARY OF THE INVENTION

A new and improved lamp assembly is provided that secures a light source to a reflector body in a simple, effective manner.

In an exemplary embodiment of the invention, the lamp assembly includes a body having a cavity and a reflector surface. A light source is received in the body cavity and a mounting clip engages the light source within the body cavity for precisely and rigidly locating the light source therein.

The mounting clip preferably grips the light source along axially spaced regions, in the preferred arrangement gripping a pinch seal region of the light source.

The mounting clip preferably includes a pair of legs that are spread apart to grip the pinch seal region of the light source and a portion that engages an internal surface of the neck, preventing inadvertent removal of the mounting clip from the body.

In another exemplary embodiment, an insulator is received around each lead extending from the light source for electrically isolating the lead from the clip.

A principal advantage of the invention resides in the secure mounting arrangement that eliminates use of cement for securing a light source to the reflector body.

Another advantage of the invention resides in the limited modifications required to existing lamp components.

Still another advantage of the invention is provided by the elimination of a component, and its attendant cost.

Yet another advantage of the invention is associated with the ease of manufacture of the mounting clip and decreased time required to assemble the lamp.

DETAILED DESCRIPTION OF THE INVENTION

Figure 1:
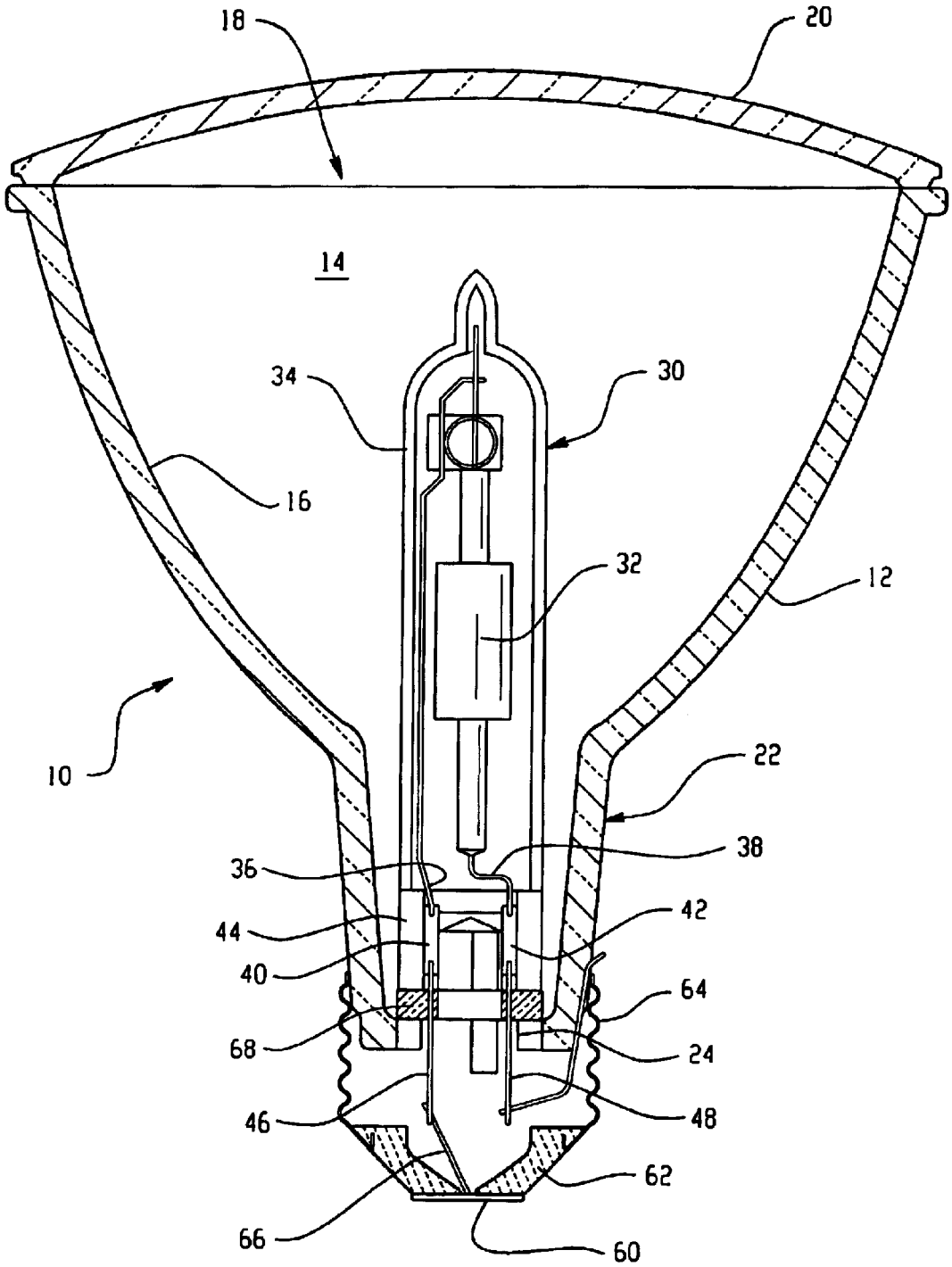
FIG. 1 is an elevation view, partly in cross-section, of a conventional ceramic metal halide reflector lamp assembly.

Turning first to FIG. 1, a lamp assembly 10 includes a body 12 defining an interior cavity 14. The body, for example, is formed from glass and has an internal reflective surface 16. The reflective surface is a concave surface, such as a paraboloid, such that light emitted from the source proceeds directly outward through a first or open end 18 or is directed by the reflective surface through the open end. It will be understood that still other surfaces of rotation than the paraboloid can be used without departing from the scope and intent of the present invention. The open end 18 is covered by lens 20 to seal the cavity 14. A second end 22 of the body has a generally narrower, tapered cylindrical configuration and is often referred to as the neck of the body. An opening 24 is formed at the terminal end of the neck.

In the prior art arrangement of FIG. 1, a light source 30 is mounted in the cavity. The light source is a single ended, ceramic metal halide capsule that includes a ceramic arc tube 32 housed within a quartz capsule 34. Particular details of the structure and operation of the ceramic metal halide light source are well known in the art and form no part of the subject invention so that the following brief discussion of the light source is deemed sufficient to a complete understanding of the present invention. Inner leads 36, 38 are connected to molybdenum foils 40, 42, respectively, disposed in a seal or pinch region 44. Extending outward from the pinch region are outer leads 46, 48, that are of molybdenum construction and extend outwardly through the opening 24 in the neck. The first outer lead 46 is electrically connected to a first electrical contact or eyelet 60 centrally disposed in an insulating material 62. Also secured to the insulating material is a second electrical contact or threaded shell 64 which is electrically connected to the second outer lead 48 via lead wire 66. As is conventional in the art, contact is made with the lamp fixture via the eyelet 60 and the shell 64 to complete the circuit with an electrical energy source (not shown) for operating the light source 30.

Although a ceramic metal halide structure has been described, it will be appreciated that the light source could be another type of arc discharge arrangement, such as a metal halide, or a halogen incandescent or filament tube. In those arrangements, the outer leads 46, 48 are typically nickel-iron leads that can support the light source. With the ceramic metal halide lamp assembly shown in FIG. 1, a glass button 68 is received beneath the pinch region of the light source. The button has a pair of openings therethrough for receiving the outer leads 46, 48. In this manner, a cement can be introduced into the shell cavity and opening 24 to secure the lamp assembly via the leads to the neck. The high temperature cement is then cured to complete the mounting of the light source in the lamp body at the desired location.

Figure 3:
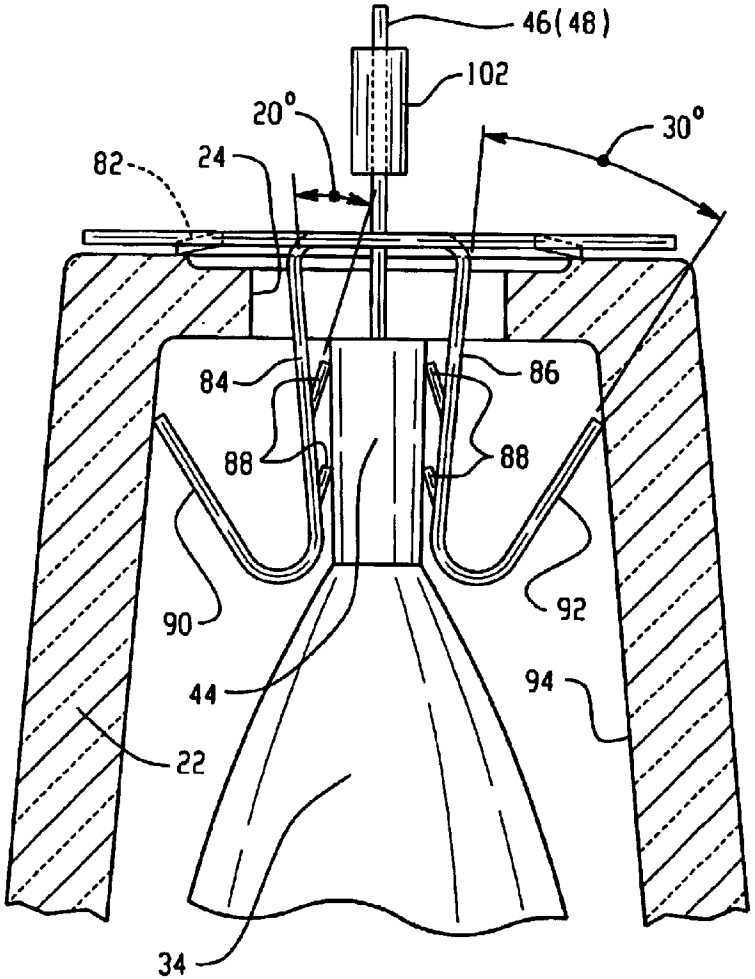
FIG. 3 is a cross-sectional view taken generally along the lines 3—3 of FIG. 2.
Figure 2:
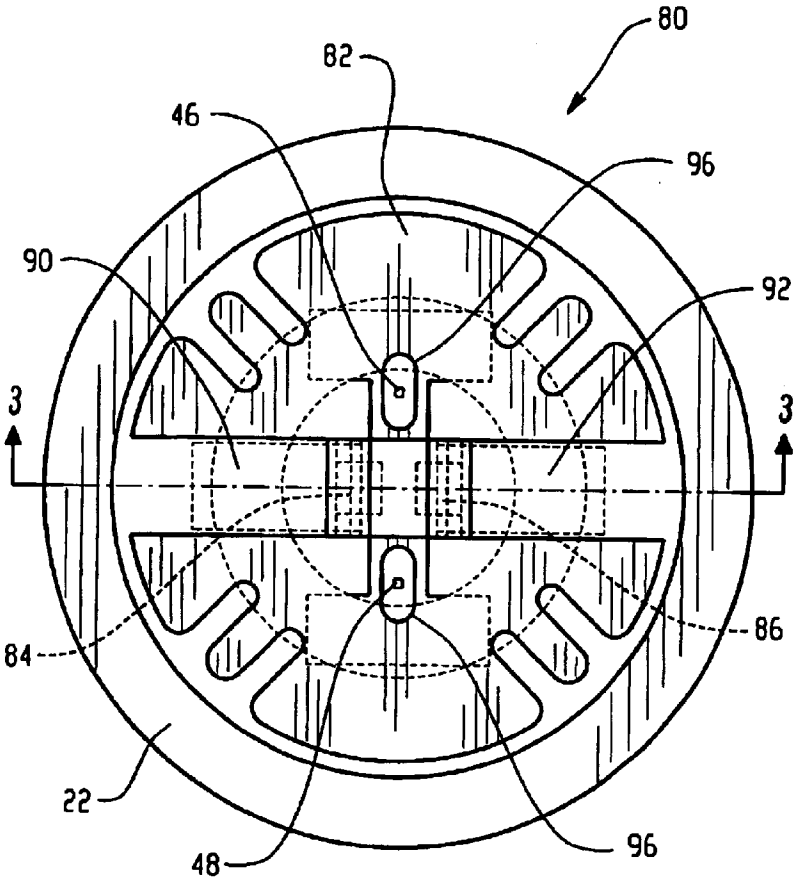
FIG. 2 is a plan view of an end of the lamp assembly according to an exemplary embodiment of the present invention.

Turning now to FIGS. 2 and 3, details of the present invention will be shown and described in greater detail. A mounting clip 80 is employed to secure the light source within the neck without using cement. More particularly, the mounting clip includes a radial shoulder or plate 82 that overlies and abuts against the outer terminal end of the neck (FIG. 3). Extending axially inward through the opening 24 are first and second legs 84, 86. The first and second legs define a first portion of the mounting clip that tightly grips the pinch seal region 44 of the light source. As will be appreciated in FIG. 3, each leg extends along the axial length of the pinch seal region and includes inwardly angled teeth 88 that engage the pinch seal region at axially spaced locations.

A second portion of each leg 84, 86 is defined by an outwardly extending flexible arm 90, 92, respectively. Each flexible arm is normally biased outwardly into compressive engagement with an internal surface 94 of the neck. In this manner, the mounting clip is axially located by abutment between the plate 82 and the end surface of the neck and tightly grips the light source at axially spaced locations via the teeth 88 on the first portion or legs of the clip, while the arms 90, 92 compressingly engage the internal surface of the neck or body. By gripping and extending along the length of the pinch region, greater stability is provided for the light source within the body. The use of the retaining clip allows the light source to be held in the body without the use of cement by gripping the pinch seal area of the light source on opposing sides in compression. In addition, the spring clip presses outwardly on the reflector neck to stabilize the position of the light source within the reflector body. This eliminates the use of a button and also, due to the elimination of the cement in its entirety, reduces assembly time since the curing process of the cement is likewise eliminated.

Figure 4:
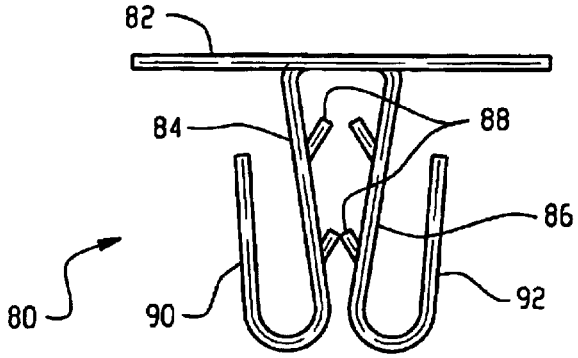
FIG. 4 is an elevational view of the retainer clip in a compressed state.

FIG. 4 illustrates the compressibility of the retaining clip. Particularly, the first legs are shown in their normally inward biased arrangement so that upon insertion of the pinch seal region of the light source, the light source is tightly gripped by the retaining clip. In addition, the arms 90, 92 are shown flexed inwardly. It will appreciated that the arms must flex inwardly to allow insertion of the arms and the legs through the opening 24 of the neck. Further axial insertion of the retaining clip into the neck through the opening 24 is precluded due to the abutment between the plate 82 and the outer external surface of the neck.

Figure 5:
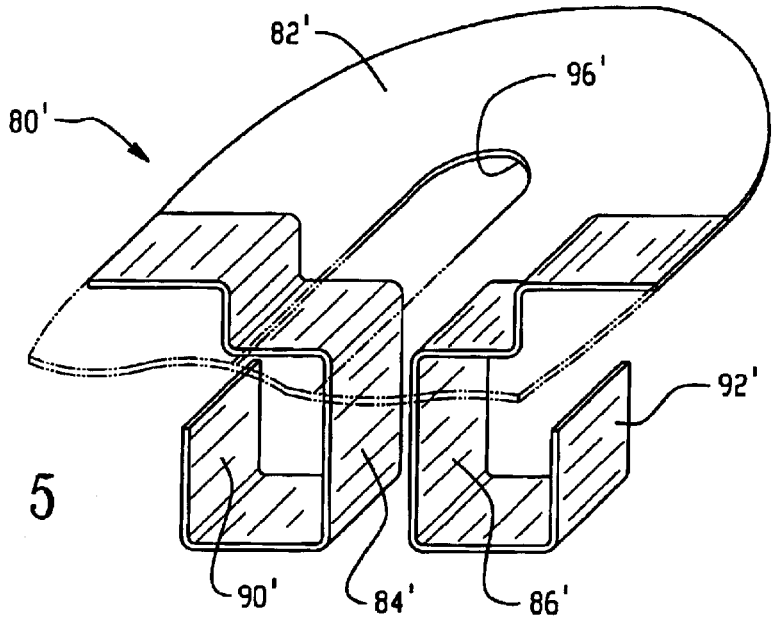
FIG. 5 is a perspective view, shown partially in section, of another preferred embodiment of the present invention.
Figure 6:
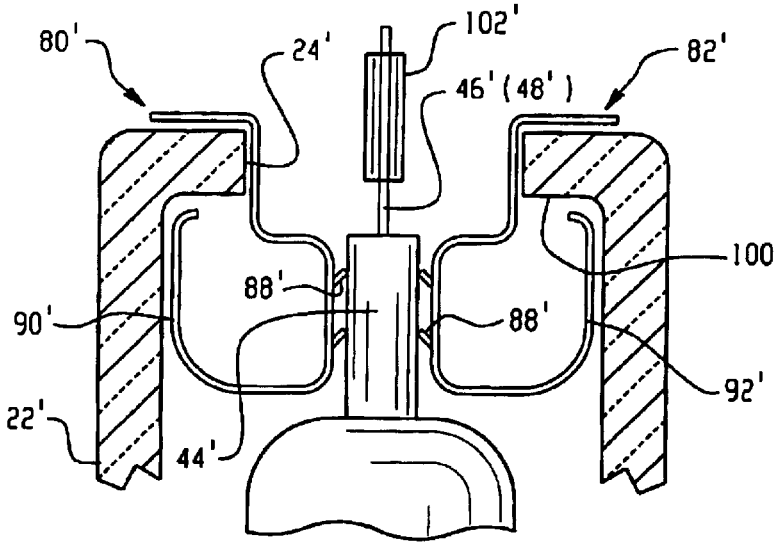
FIG. 6 is a longitudinal cross-sectional view of another preferred embodiment.

FIGS. 5 and 6 illustrate slightly modified embodiments of a retaining clip. For purposes of brevity, like components will be identified by like reference numerals with a primed suffix, while new components will be identified with new numerals. In FIG. 5, the plate 82' has a generally elliptical configuration with a single, central opening 96' (as contrasted to the separate openings in the embodiment of FIGS. 2–4). The legs 84', 86' and arms 90', 92' are slightly modified in their configuration. That is, the arms in association with the respective legs form a generally U-shaped configuration. This provides for axial engagement by the terminal ends of the arms on an inner shoulder 100 of the neck surrounding the opening 24. This, in conjunction with the plate 82' engaging the outer surface of the neck provides for a precise axial location of the mounting clip in the lamp assembly.

In the FIG. 5 embodiment, the clip is a one-piece construction. This is contrasted with FIG. 6 which illustrates a pair of like clips received through the openings 24' on opposite sides of the pinch seal region 44'.

It is contemplated that an insulator 102 (FIG. 6) formed from electrically insulated material, can be received over each of the leads 46', 48' that extend through the neck. This assures that the retaining clip(s) does not inadvertently short the electrical circuit established through the leads for powering the light source. Again, teeth 88' extend inwardly from the first and second legs for gripping the external surface of the pinch region of the light source.

It will be appreciated that the present invention eliminates the use of cement, and just as importantly, achieves a secure mounting of the light source relative to the body with minimal, if any, modification of the lamp components. A robust clip design that provides for stability and secure mounting of the light source in the body is achieved with the present design. The retaining clip can be conveniently stamped from a unitary piece of metal, and easily inserted through the opening in the neck base, as described above. Subsequently, the light source is advanced from the first end of the body with the pinch region extending into the neck where it is securely engaged by the cooperating legs of the mounting clip.

The invention has been described with reference to the preferred embodiment. Obviously, modifications and alterations will occur to others upon a reading and understanding of this specification. The invention is intended to include all such modifications and alterations in so far as they come within the scope of the appended claims and the equivalents thereof.

What is claimed is:

1. A lamp assembly comprising:

a body having a cavity and a reflector surface;

a light source received in the body cavity at a predetermined position so that at least a portion of light emanating from the light source is directed toward the reflector surface at least one lead extending from the light source;

a mounting clip having a first portion for externally gripping the light source and a second portion for compressively engaging the body cavity and for locating the light source therein; and at least one insulator received around each lead for electrically isolating the lead from the clip.

2. The lamp assembly of claim 1 wherein the mounting clip first portion grips the light source along axially spaced regions.

3. The lamp assembly of claim 2 wherein the mounting clip first portion grips a pinch seal region of the light source.

4. The lamp assembly of claim 2 wherein the mounting clip first portion includes gripping teeth angled to grip the light source.

5. The lamp assembly of claim 1 wherein the mounting clip is a one-piece component.

6. The lamp assembly of claim 5 wherein the mounting clip first portion includes first and second legs extending in generally parallel fashion.

7. The lamp assembly of claim 6 wherein the legs are spaced apart for close receipt of a pinch region of the light source.

8. The lamp assembly of claim 7 wherein the legs each include teeth extending outwardly therefrom toward the other leg.

9. The lamp assembly of claim 6 wherein each leg includes an extended portion directed my from the other leg for engaging an interior surface of the body.

10. The lamp assembly of claim 9 wherein the extended portions are flexible and urge the legs together in the absence of the light source pinch region.

11. The lamp assembly of claim 5 wherein the mounting clip includes a shoulder region dimensioned for receipt over an end of the body to locate the clip relative thereto.

12. A lamp assembly comprising:

a body having a concave reflecting surface that opens toward a first end and a neck at a second end having an opening extending therethrough;

a light source received in the body adjacent the reflecting surface and a first end extending into the neck;

a spring clip that mechanically secures the light source to the body without the use of cement, the clip including a radial shoulder at a first end that engages the neck at the second end and a flexible section that compressively engages the first end of the light source and an internal surface of the neck, the clip includes at least one opening that receives a lead from the light source therethrough; and an insulator received between the lead and the clip at the opening to electrically isolate the lead from the clip.

13. The lamp assembly of claim 12 wherein the light source is one of an incandescent or arc discharge source.

14. The lamp assembly of claim 13 wherein the light source is a ceramic metal halide.

15. The lamp assembly of claim 12 wherein the light source includes a pinch region and the flexible section of the clip engages the pinch region at radially spaced locations thereof.

16. The lamp assembly of claim 12 wherein the flexible section includes first and second legs normally biased toward one another and extensions protruding from each leg into compressive engagement with an interior surface of the neck.

17. A lamp assembly comprising:

a ceramic metal halide light source;

a reflector body, the body having a narrow neck at least partially receiving the light source therein and a surface internal to said body; and a one-piece metal clip having first portions that grip an external surface of a seal region of the light source therebetween and a second portion that compressingly engages to said internal surface of the body for accurately locating the light source therein.

18. The lamp assembly of claim 17 wherein the clip first portions grippingly engage the light source seal region at plural, axially spaced regions for improving stability of the light source within the body.

19. The lamp assembly of claim 17 wherein the clip includes a radial shoulder dimensioned to overlie and abut against an outer terminal end of the neck.

* * * * *